US008829797B2

(12) United States Patent
McMahon

(10) Patent No.: US 8,829,797 B2
(45) Date of Patent: Sep. 9, 2014

(54) LIGHTING SYSTEMS AND DEVICES INCLUDING MULTIPLE LIGHT-EMITTING DIODE UNITS AND ASSOCIATED METHODS

(75) Inventor: Steven A. McMahon, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 12 days.

(21) Appl. No.: 13/598,374

(22) Filed: Aug. 29, 2012

(65) Prior Publication Data

US 2014/0062311 A1 Mar. 6, 2014

(51) Int. Cl.

| | |
|---|---|
| ***H05B 37/02*** | (2006.01) |
| ***H05B 39/04*** | (2006.01) |
| ***H05B 41/36*** | (2006.01) |

(52) U.S. Cl.

USPC ..... 315/154; 315/149; 315/152; 315/159; 315/119

(58) Field of Classification Search

None

See application file for complete search history.

(56) References Cited

U.S. PATENT DOCUMENTS

| | | | | |
|---|---|---|---|---|
| 6,641,294 | B2 * | 11/2003 | Lefebvre | 362/544 |
| 7,173,383 | B2 * | 2/2007 | Vornsand et al. | 315/291 |
| 7,985,004 | B1 | 7/2011 | Schach et al. | |
| 7,988,327 | B1 | 8/2011 | Knoble et al. | |
| 8,471,480 | B2 * | 6/2013 | Kinderman et al. | 315/185 R |
| 2011/0304270 | A1 | 12/2011 | Scarpelli | |
| 2012/0080944 | A1 * | 4/2012 | Recker et al. | 307/25 |

OTHER PUBLICATIONS

Joel, S. et al., Lighting California's Future: Cost-Effective Demand Response, California Energy Commission, PIER Building End-Use Energy Efficiency Program, Mar. 2011, 44 pages, CEC-500-2011-014.

Peck, J. et al., Solid State LED Lighting Technology for Hazardous Environments; Lowering Total Cost of Ownership While Improving Safety, Quality of Light and Reliability, Petroleum and Chemical Industry Conference Europe Conference Proceedings, Jun. 2011, 8 pages.

Porter, J., Lighting California's Future: Integration of Lighting Controls With Utility Demand Response Signals, California Energy Commission, PIER Building End-Use Energy Efficiency Program, Mar. 2011, 43 pages, CEC-500-2011-012.

* cited by examiner

*Primary Examiner* — Anh Tran

(74) *Attorney, Agent, or Firm* — Perkins Coie LLP

(57) ABSTRACT

Lighting systems including lighting fixtures having multiple light-emitting diode units and associated devices, systems, and methods are disclosed herein. A lighting system configured in accordance with a particular embodiment includes a plurality of lighting fixtures individually including first and second light-emitting diode units. The system further includes a power source, first wiring operably connecting the first light-emitting diode units to the power source, and second wiring operably connecting the second light-emitting diode units to the power source. An automatic controller is operably connected to the first wiring such that the second light-emitting diode units operate independently of the automatic controller. A method for operating a lighting system in accordance with a particular embodiment includes reducing power to a first light-emitting diode unit of a lighting fixture in response to an automatically generated signal without reducing power to a second light-emitting diode unit of the lighting fixture.

30 Claims, 4 Drawing Sheets

LIGHTING SYSTEMS AND DEVICES INCLUDING MULTIPLE LIGHT-EMITTING DIODE UNITS AND ASSOCIATED METHODS

TECHNICAL FIELD

The present technology is related to, inter alia, lighting systems, lighting fixtures, methods for operating lighting systems, and methods for installing lighting systems.

BACKGROUND

Lighting systems including light-emitting diodes (LEDs) are becoming increasingly popular for general and targeted lighting in homes, businesses, outdoor areas, and other settings. In comparison to fluorescent lighting systems, LED lighting systems are typically more compact, convenient, and aesthetically pleasing. In comparison to incandescent lighting systems, LED lighting systems are typically more energy efficient. There is also increasing demand for lighting systems with automatic controls that can further improve convenience and energy efficiency. For example, some lighting systems include occupancy sensors that automatically turn lights on only when building occupants are present and automatically turn lights off to save energy when building occupants are not present. As another example, many electricity providers have demand-response programs in which participating electricity customers can receive credits for reducing their electricity consumption during periods of peak overall electricity demand within the provider's power grid.

FIG. 1 is a partially schematic circuit diagram illustrating a conventional lighting system 100 configured for automatic control. The system 100 includes a power source 102, a plurality of fluorescent lighting fixtures 104 (individually identified as 104*a-e*), and wiring 106 operably connecting the fixtures 104*a-e* and the power source 102. The fixtures 104*a-e* individually include leads 108, and the system 100 further includes electrical connectors 110 connecting the leads 108 and the wiring 106 such that the fixtures 104*a-e* are electrically coupled in series. Two of the leads 108 of the last fixture 104*e* in the series are connected to one another and electrically insulated within a cap 112. The system 100 further includes an automatic controller 114 operably connected to the wiring 106. The automatic controller 114 is configured to receive a signal 116 from a signal source 118 and to automatically shut off the fixtures 104 in response to the signal 116.

Use of the automatic controller 114 with the lighting system 100 can be problematic. For example, the automatic controller 114 may cause the fixtures 104*a-e* to shut off at inconvenient times. Demand-response events typically occur when grid-wide electricity demand is highest, which is typically also when individual electricity customers have the greatest need for lighting. Furthermore, completely shutting off the fixtures 104 can adversely affect safety, worker efficiency, merchandising, and/or have other undesirable consequences. Accordingly, while many building owners are eager to implement automatic control for non-lighting systems (e.g., air-conditioning systems and refrigeration systems, among others), the same building owners are often justifiably reluctant to implement automatic control for lighting systems. These building owners may determine that their lighting systems are too important to be automatically controlled even if doing so would reduce costs and/or benefit the environment. By some estimates, lighting may account for as much as 5-10% of all energy use in the United States. Accordingly, improved controls are needed.

One conventional approach to facilitating more widespread adoption of automatic control for lighting systems includes using controllers that dim rather than shut off the light output. Using this approach, lighting systems can provide at least some light during periods of automatically lowered power consumption, e.g., during demand-response events. Unfortunately, many lighting fixtures are not dimmable or require complex retrofitting to become dimmable. Furthermore, lighting fixtures that are dimmable tend to be more expensive, less reliable, and less durable than lighting fixtures that are not dimmable. For example, even many high-end dimmable LED fixtures periodically flicker, unexpectedly shut off, or experience other types of poor or failed operation. For these and/or other reasons, conventional dimming alone may be inadequate to encourage more widespread adoption of automatic control for lighting systems. There is a need for further innovation to address this problem and/or one or more other problems associated with conventional lighting technology.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology.

DETAILED DESCRIPTION

Specific details of several embodiments of, inter alia, lighting systems, lighting fixtures, methods for operating lighting systems, and methods for installing lighting systems are described herein with reference to FIGS. 2-5. A person having ordinary skill in the relevant art will understand that the present technology may have additional embodiments, and that the present technology may be practiced without several of the details of the embodiments described herein with reference to FIGS. 2-5. For ease of reference, throughout this disclosure identical reference numbers are used to identify similar or analogous components or features, but the use of the same reference number does not imply that the components or features should be construed to be identical.

Figure 1:
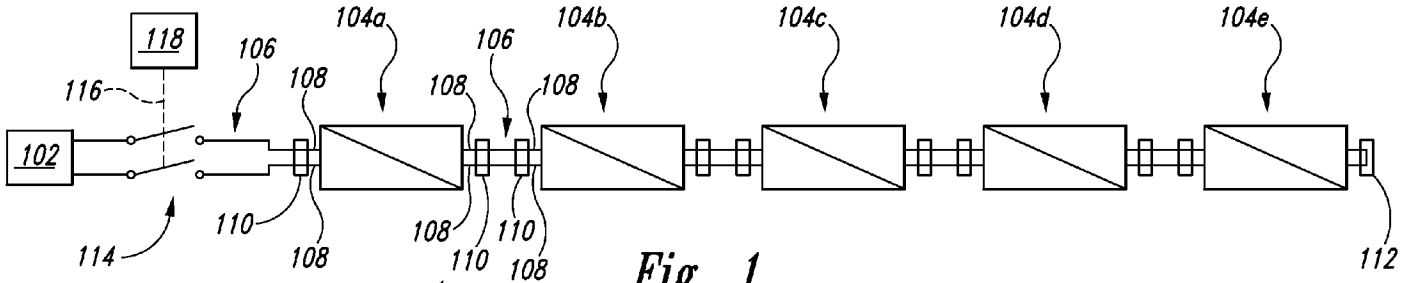
Fig. 1 (Prior Art)
FIG. 1 is a partially schematic circuit diagram illustrating a lighting system including multiple lighting fixtures and an automatic controller in accordance with the prior art.
Figure 2:
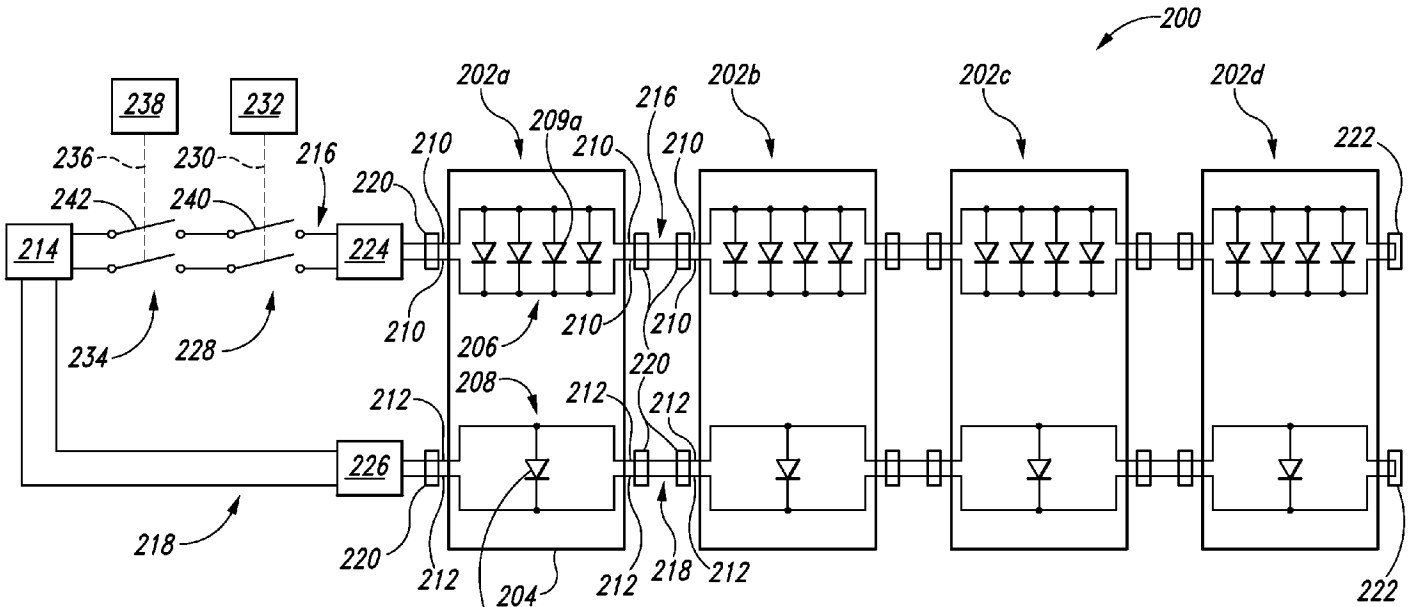
FIGS. 2-5 are partially schematic circuit diagrams illustrating lighting systems including multiple lighting fixtures and one or more automatic controllers in accordance with embodiments of the present technology.

FIG. 2 is a partially schematic circuit diagram illustrating a lighting system 200 including a plurality of lighting fixtures 202 (individually identified as 202*a-d*) in accordance with an embodiment of the present technology. The lighting fixtures 202 can individually include a housing 204, a first LED unit 206, and a second LED unit 208. The first and second LED units 206, 208 can be operationally independent lighting circuits. For example, the first lighting units 206 can individually include one or more first LEDs 209*a*, the second LED units 208 can individually include one or more second LEDs 209*b*, and the first LEDs 209*a* can be automatically controlled without affecting the operation of the second LEDs 209*b*. Accordingly, rather reducing power to all of the LEDs 209*a-b* of the fixtures 202*a-d* during a demand-response event or another period of automatically lowered power consumption, a suitable quantity of the LEDs 209*a-b* can be shut off, while another quantity of the LEDs 209*a-b* remain at full power.

The first LED units 206 can individually include a quantity of first LEDs 209*a* greater than a quantity of second LEDs 209*b* of a corresponding second LED unit 208. For example, the first LED unit 206 of the lighting fixture 202*a* can include at least two, at least five, at least 10, at least 20, or another suitable quantity of first LEDs 209*a* and the corresponding second LED unit 208 in the lighting fixture 202*a* can include a smaller quantity of second LEDs 209*b*. The quantity of second LEDs 209*b* and/or the maximum light output from the second LEDs 209*b* of the second LED units 208 individually can be less than about 25%, e.g., less than about 20% or less than about 15%, of the quantity of first LEDs 209*a* and/or the maximum light output from the first LEDs 209*a* of a corresponding first LED unit 206. In some embodiments, the LEDs 209*a-b* of the first and second LED units 206, 208 together can provide primary or normal-level lighting, while the second LEDs 209*b* of the second LED units 208 alone provide secondary or dim-level lighting.

The lighting fixtures 202*a-d* can include first leads 210 and second leads 212 accessible from exteriors of the housings 204. Each housing 204, for example, can include a metal or plastic case and the first and second leads 210, 212 can be wires extending through one or more openings in the case. In some embodiments, the first and second leads 210, 212 can be prongs or sockets of fixed connectors (not shown) on the housings 204, or the first and second leads 210, 212 can have other suitable configurations. The first and second leads 210, 212 can be operably connected to the first and second LED units 206, 208, respectively. The system 200 can further include a power source 214, first wiring 216 operably connecting the first LED units 206 and the power source 214, and second wiring 218 operably connecting the second LED units 208 and the power source 214. For example, the system 200 can include electrical connectors 220 connecting the first and second leads 210, 212 and the first and second wiring 216, 218, respectively, such that the fixtures 202*a-d* are electrically coupled in series. The last fixture 204*d* in the series can include two first leads 210 electrically connected to one another and two second leads 212 electrically connected to one another, and the system 200 can include caps 222 electrically insulating these electrically connected pairs of first and second leads 210, 212.

The power source 214 can be an alternating current power source, e.g., a load center of a building connected to a municipal power grid, and the system 200 can further include a first rectifier 224 operably connected to the first wiring 216 and a second rectifier 226 operably connected to the second wiring 218. The first and second rectifiers 224, 226 can be configured to convert alternating current from the power source 214 into direct current before delivery to the LEDs 209*a-b* of the first and second LED units 206, 208. In other embodiments, the system 200 can include other suitable driver components in addition to or instead of the first and second rectifiers 224, 226.

As shown in FIG. 2, the system 200 can include a first automatic controller 228 operably connected to the first wiring 216. The first automatic controller 228 can be configured to receive a first signal 230 from a first signal source 232. Similarly, the system 200 can include a second automatic controller 234 also operably connected to the first wiring 216. The second automatic controller 234 can be configured to receive a second signal 236 from a second signal source 238. In some embodiments, the first automatic controller 228 can include a normally closed relay 240 and the second automatic controller 234 can include a normally open relay 242. For example, the first automatic controller 228 can be configured to shut off power to the first LED units 206 in response to the first signal 230, and the second automatic controller 234 can be configured to turn on power to the first LED units 206 in response to the second signal 236. The normally closed and normally open relays 240, 242 can be alternating current relays. Accordingly, the first rectifier 224 can be between the first automatic controller 228 and the first LED units 206. In some embodiments, the normally closed and normally open relays 240, 242 can share a housing (not shown) with the first rectifier 224. The second rectifier 226 can be operably connected to the second wiring 218 between the power source 214 and the second LED units 208.

The system 200 is compatible with a variety of control schemes. For example, the first automatic controller 228 can be a demand-response controller, the first signal 230 can be a demand-response signal, and the first signal source 232 can be a remote demand-response control center. The second automatic controller 234 can be an occupancy-based controller, the second signal 236 can be an occupancy signal, and the second signal source 238 can be an occupancy sensor, e.g., a motion detector, that is part of the system 200. The second LED units 208 can operate independently of the first and second automatic controllers 228, 234. For example, either one of the first or second automatic controllers 228, 234 can disconnect the power source 214 from the first LED units 206 without disconnecting the power source 214 from the second LED units 208. The second LED units 208 can thus operate continuously. Accordingly, when the first and second automatic controllers 228, 234 are a demand-response controller and an occupancy-based controller, respectively, the system 200 can be configured to provide dim-level lighting via the second LED units 208 even during demand-response events and periods when an occupant is not present. In some embodiments a method for operating the system 200 can include temporarily reducing power to the first LED units 206 in response to an automatically generated signal (e.g., the first signal 230 and/or the second signal 236), while continuously powering the second LED units 208 without reducing power to the second LED units 208. Accordingly, at least a minimum acceptable level of lighting for safety, worker efficiency, merchandising, and/or other purposes can be maintained even if additional lighting capacity is temporarily shut off.

Figure 3:
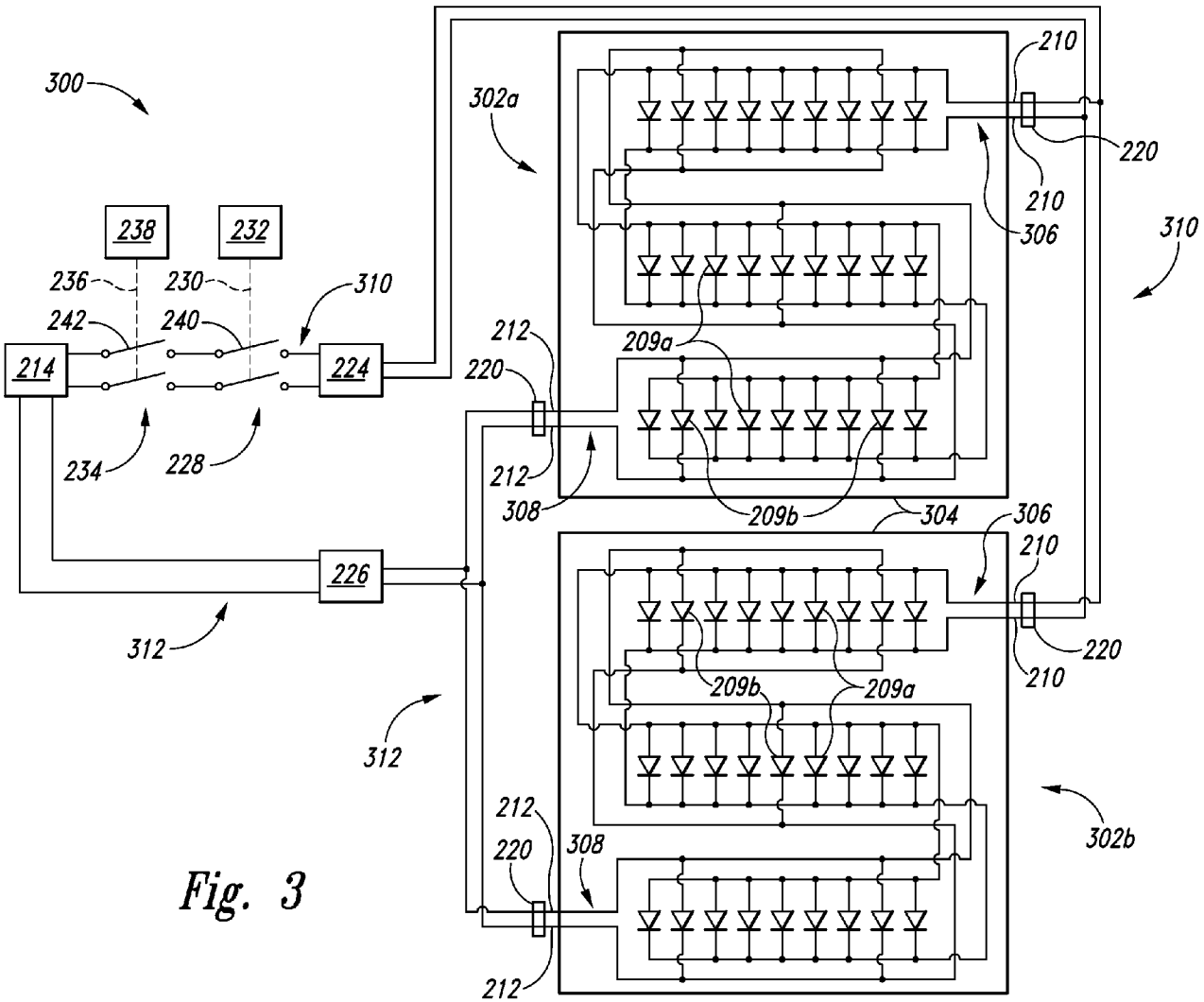

FIG. 3 is a partially schematic circuit diagram illustrating a lighting system 300 including a plurality of lighting fixtures 302 (individually identified as 302*a*, 302*b*) in accordance with another embodiment of the present technology. The fixtures 302*a*, 302*b* can individually include a housing 304, a first LED unit 306, and a second LED unit 308. The system 300 can further include first wiring 310 operably connecting the first LED units 306 and the power source 214, and second wiring 312 operably connecting the second LED units 308 and the power source 214. As shown in FIG. 3, the fixtures 302*a*, 302*b* as well as the LEDs 209*a-b* of the first and second LED units 306, 308 can be electrically coupled in parallel. Furthermore, the second LEDs 209*b* of the second LED units 308 can be interspersed among the first LEDs 209*a* of the first LED units 306. This can be useful, for example, to allow the distribution of the dim-level lighting from the fixtures 302*a*, 302*b* to more closely correspond to the distribution of the normal-level lighting from the fixtures 302*a*, 302*b* than would be the case if the second LEDs 209*b* of the second LED units 308 were separate from the first LEDs 209*a* of the first LED units 306. In many applications, e.g., in merchandise lighting and other targeted lighting applications, the placement of the fixtures 302*a*, 302*b* may be carefully selected to achieve desirable lighting distribution. Interspersing the second LEDs 209*b* of the second LED units 308 among the first LEDs 209*a* of the first LED units 306 can preserve this desirable lighting distribution, albeit at a lower level, during periods of automatically lowered power consumption.

Figure 4:
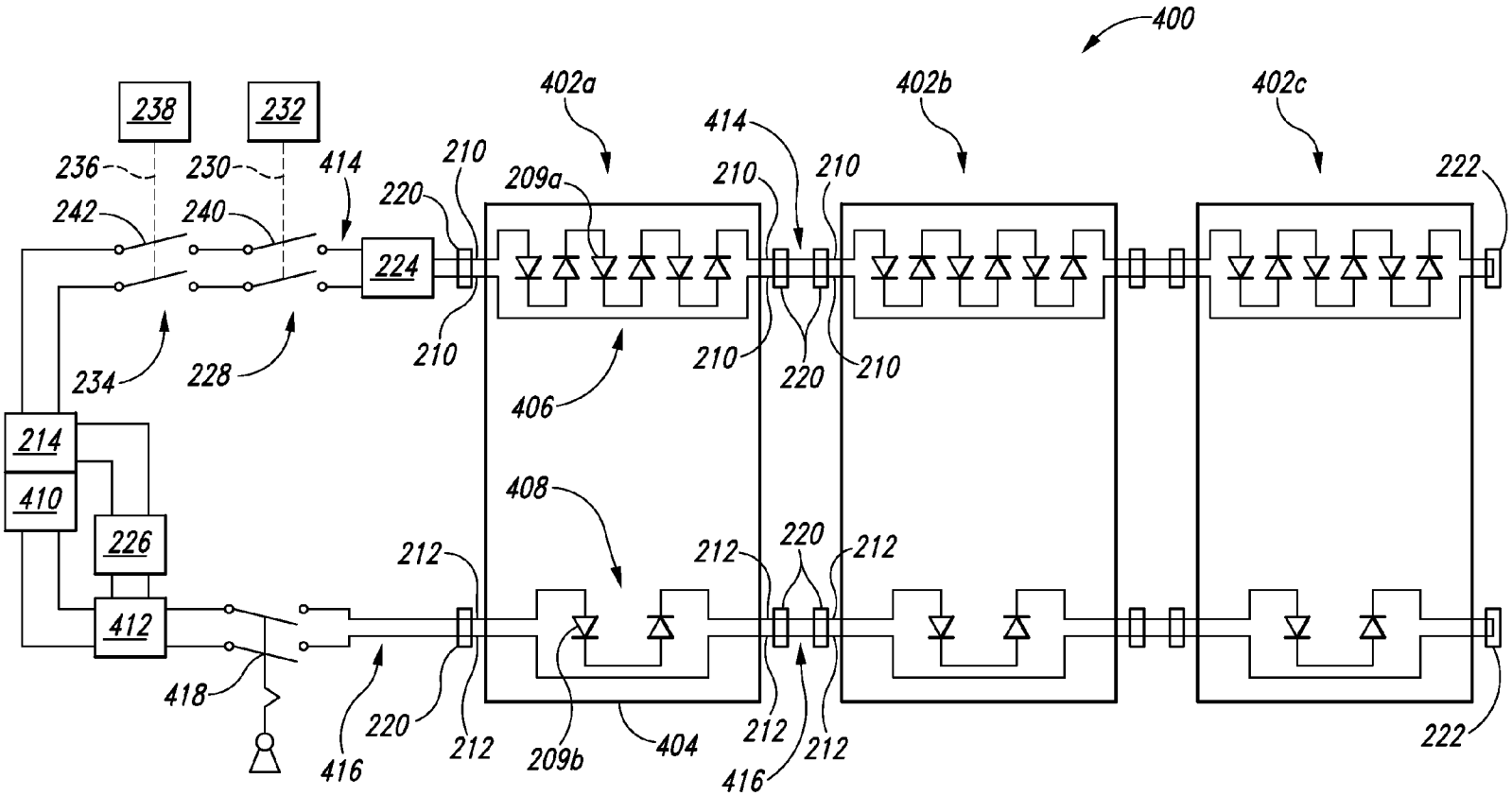

FIG. 4 is a partially schematic circuit diagram illustrating a lighting system 400 including a plurality of lighting fixtures 402 (individually identified as 402*a-c*) in accordance with another embodiment of the present technology. The fixtures 402*a-c* can individually include a housing 404, a first LED unit 406, and a second LED unit 408. The system 400 can further include a battery 410, a battery relay 412, first wiring 414 operably connecting the first LED units 406 and the power source 214, and second wiring 416 operably connecting the second LED units 408 and the power source 214 via the battery 410 and the battery relay 412. As shown in FIG. 4, the fixtures 402*a-c* as well as the LEDs 209*a-b* of the first and second LED units 406, 408 can be electrically coupled in series. The battery 410 can be, for example, a back-up power supply configured for use when the power source 214 is not operational, e.g., during a power outage. In some cases, the battery 410 can be float charged with electricity from the power source 214. The first LED units 406 can operate independently of the battery 410.

Commercial building codes typically require some form of emergency egress lighting that can provide at least a minimum level of lighting during power outages. These code provisions are intended to ensure that building occupants have sufficient light to exit a building safely in emergencies, e.g., fires, earthquakes, etc. In the system 400 shown in FIG. 4, the second LED units 408 can provide emergency egress lighting in place of or in addition to a separate emergency egress lighting system. In conventional emergency egress lighting systems, each lighting fixture in the system typically includes a separate battery. These batteries can be costly, bulky, and/or difficult to maintain. In contrast, the battery 410 of the system 400 can provide energy to all of the fixtures 402*a-c* to reduce or eliminate the need for separate batteries within the individual fixtures 402*a-c*. Accordingly, in some cases, the battery 410 can reduce costs, allow the fixtures 402*a-c* to be less bulky than conventional emergency egress lighting fixtures, and/or faciliate maintenance.

The battery relay 412 can be configured to switch the power supply for the second LED units 408 from the power source 214 to the battery 410 during a power outage. As shown in FIG. 4, the battery relay 412 can be operably connected to the power source 214, the battery 410, and the second wiring 416. In a first state, the battery relay 412 can operably connect the second wiring 416 and the power source 214 and, in a second state, the battery relay 412 can operably connect the second wiring 416 and the battery 410. The battery 410 can supply direct current and the battery relay 412 can be configured to receive direct current. Accordingly, in some embodiments, the second rectifier 226 can be between the power source 214 and the battery relay 412. In other embodiments, the battery relay 412 and the second rectifier 226 can be eliminated and the second LED units 408 can be powered by the battery 410 only.

The system 400 can further include a controlled-access switch 418 (e.g., a keyed switch) operably connected to the second wiring 416, e.g., between the battery relay 412 and the second LED units 408. In certain circumstances, it can be useful to manually disconnect the second LED units 408, e.g., when the fixtures 402*a-c* are being moved or serviced or when there is another need to completely shut off the fixtures 402*a-c*. In some cases, the controlled-access switch 418 can provide this functionality without unduly reducing the reliability of the second LED units 408 for providing emergency egress lighting and/or without sacrificing compliance with building codes that prohibit freely accessible switches on emergency egress lighting.

Figure 5:
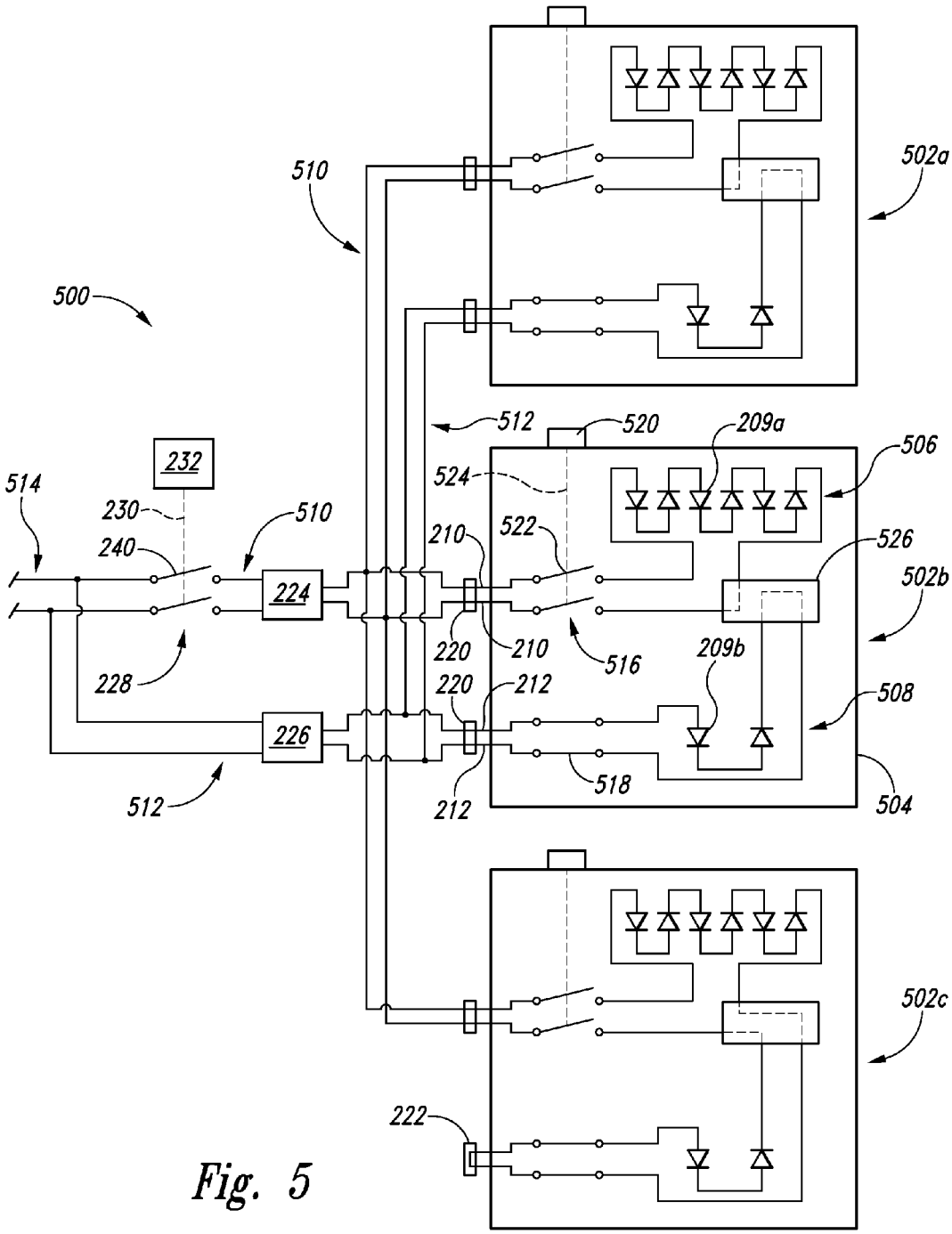

FIG. 5 is a partially schematic circuit diagram illustrating a lighting system 500 including a plurality of lighting fixtures 502 (individually identified as 502*a-c*) in accordance with another embodiment of the present technology. The fixtures 502*a-c* can individually include a housing 504, a first LED unit 506, and a second LED unit 508. The system 500 can further include first wiring 510, second wiring 512, and a power source 514. The power source 514, for example, can include shared wiring between a building load center (not shown) and the first and second wiring 510, 512. The first wiring 510 can operably connect the first LED units 506 and the power source 514, and the second wiring 512 can operably connect the second LED units 508 and the power source 514. As shown in FIG. 5, the fixtures 502*a-c* can be electrically coupled in parallel and the LEDs 209*a-b* of the first and second LED units 506, 508 can be electrically coupled in series. As shown in FIGS. 2-5 collectively, the lighting fixtures 202*a-d*, 302*a*, 302*b*, 402*a-c*, 502*a-c* and the LEDs 209*a-b* configured in accordance with embodiments of the present technology can have a variety of suitable electrical configurations.

With reference again to FIG. 5, in some embodiments, the fixtures 502*a-c* can individually include a third automatic controller 516 operably connected to the first LED unit 506. The third automatic controller 516, for example, can be an occupancy-based controller including an occupancy sensor 520 and a normally open relay 522 configured to receive an occupancy signal 524 from the occupancy sensor 520. The second LED units 508 can operate independently of the third automatic controllers 516. The third automatic controllers 516 can allow for greater energy savings than a shared automatic controller, e.g., the second automatic controller 234 shown in FIGS. 2-4. For example, when the fixtures 502*a-c* are installed in separate offices, the occupancy sensors 520 can allow the fixtures 502*a-c* to provide normal-level lighting in occupied offices and dim-level lighting in unoccupied offices. The fixtures 502*a-c* can also individually include a manual controller 518, e.g., an on/off switch, operably connected to the second LED unit 508. Similar to the controlled-access switch 418 described above with reference to FIG. 4, the manual controller 518 can be useful to allow the fixtures 502*a-c* to be completely shut off in certain circumstances.

In some cases, it can be desirable for some of the fixtures 502*a-c* of the system 500 to provide lighting at the normal level only while others provide lighting at both the normal level and the dim level. The appropriate configurations of the individual fixtures 502*a-c* are sometimes best determined at or shortly after the time of installation. For example, empirical testing, e.g., with a light meter, can be used to determine how many of the fixtures 502*a-c* should provide lighting at both the normal level and the dim level in order to achieve minimum acceptable dim-level lighting, e.g., according to an applicable building code. As another example, one or more of the fixtures 502*a-c* that are proximate areas that do not benefit from dim-level lighting, e.g., areas far removed from egress paths, can be selected to provide lighting only at the normal level or completely shut off. Since, at least in some cases, the dim-level lighting remains on continuously or near continuously, the energy savings from eliminating unnecessary dim-level lighting can be significant.

The fixtures 502*a-c* can be adaptable to faciliate eliminating unnecessary dim-level lighting without leaving the second LED units 508 unutilized. For example, the fixtures 502*a-c* can individually include a junction switch 526 operably connected to the first and second LED units 506, 508.

The junction switch 526 can have a first state in which it electrically connects the first and second LED units 506, 508 together and a second state in which the first and second LED units 506, 508 are electrically isolated from one another. In the system 500, the junction switches 526 of the fixtures 502*a*, 502*b* are in the second state and the junction switch 526 of the fixture 502*c* is in the first state. Using the junction switches 526, the fixtures 502*a-c* can be conveniently adapted to provide either lighting at the normal level only or lighting at both the normal level and the dim level. The junction switches 526, for example, can be manual switches, be junction boxes where wires of the first and second LED units 506, 508 are brought into close proximity, or have other suitable forms.

A method for installing the lighting system 500 in accordance with an embodiment of the present technology can include, for example, positioning the fixtures 502*a-c* proximate one or more areas to be illuminated, operably connecting the first wiring 510 the power source 514 and at least some of the first leads 210, and operably connecting the second wiring 512 to the power source 514 and at least some of the second leads 212. The method can further include operably connecting the first automatic controller 228 and/or the second automatic controller 234 (FIGS. 2-4) to the first wiring 510 such that the second LED units 508 operate independently of the first automatic controller 228 and/or the second automatic controller 234. In some embodiments, the first and second LED units 506, 508 can be operably connected in one or more of the fixtures 502*a-c* to reduce the total dim-level light output from the system 500. For example, the first wiring 510 can be operably connected to one of the first and second leads 210, 212 of one or more of the fixtures 502*a-c*, and the other of the first and second leads 210, 212 can be capped.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. For example, the lighting systems described herein can include any suitable number of lighting fixtures and individual the lighting fixtures can include any suitable number of LEDs. As another example, the LED units described herein can be replaced with units including one or more other types of solid-state devices, e.g., microprocessors, memory, and non-LED transducers, among others. In some cases, well-known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. For example, the battery 410, the battery relay 412, and/or the controlled-access switch 418 of the system 400 illustrated in FIG. 4 can be included in the embodiments illustrated in FIGS. 2, 3, and 5. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown or described herein.

Certain aspects of the present technology may take the form of computer-executable instructions, including routines executed by a controller or other data processor. In some embodiments, a controller or other data processor can be specifically programmed, configured, or constructed to perform one or more of these computer-executable instructions. Furthermore, some aspects of the present technology may take the form of data, e.g., non-transitory data, stored or distributed on computer-readable media, including magnetic or optically readable or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout to mean including at least the recited feature(s) such that any greater number of the same feature and/or additional types of other features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

I claim:

1. A lighting system, comprising:

an alternating current power source;

a plurality of lighting fixtures individually including— a first light-emitting diode unit, and a second light-emitting diode unit;

first wiring operably connecting the first light-emitting diode units to the power source;

second wiring operably connecting the second light-emitting diode units to the power source;

an automatic controller operably connected to the first wiring;

a float-charged battery;

a battery relay operably connected to the power source, the float-charged battery, and the second wiring, the battery relay having a first state in which the battery relay operably connects the second wiring and the power source and a second state in which the battery relay operably connects the second wiring and the float-charged battery;

a first rectifier operably connected to the first wiring between the automatic controller and the first light-emitting diode units; and a second rectifier between the power source and the battery relay, wherein— the first light-emitting diode units operate independently of the float-charged battery, and the second light-emitting diode units operate independently of the automatic controller such that the second light-emitting diode unit of a given one of the lighting fixtures operate independently of the first light-emitting diode unit of the same lighting fixture.

2. The lighting system of claim 1, wherein the automatic controller includes a normally closed relay.

3. The lighting system of claim 1, further comprising a controlled-access switch operably connected to the second wiring.

4. The lighting system of claim 1, wherein the power source includes:

a load center of a building; and shared wiring between the load center and the first and second wiring.

5. The lighting system of claim 1, wherein the automatic controller is a demand-response controller configured to receive a demand-response signal.

6. A lighting system, comprising:

a power source;

plurality of lighting fixtures individually including— a first light-emitting unit, and a second light-emitting diode unit;

first wiring operably connecting the first light-emitting diode units to the power source;

second wiring operably connecting the second light-emitting diode units to the power source;

a first automatic controller operably connected to the first wiring, the first automatic controller being a demand-response controller configured to receive a demand-response signal; and a second automatic controller operably connected to the first wiring, the second automatic controller including an occupancy sensor, wherein the second light-emitting diode units operate independently of the first and second automatic controllers such that the second light-emitting diode unit of a given one of the lighting fixtures operates independently of the first light-emitting diode unit of the same lighting fixture.

7. The lighting system of claim 6, wherein the second light-emitting diode unit of the given one of the lighting fixtures has a maximum light output less than about 25% of a maximum light output of the first light-emitting diode unit of the same lighting fixture.

8. The lighting system of claim 7, wherein:

the first light-emitting diode unit of the given one of the lighting fixtures includes a first type of light-emitting diodes individually having a first maximum light output;

the second light-emitting diode unit of the given one of the lighting fixtures includes a second type of light-emitting diodes individually having a second maximum light output; and the second maximum light output is less than the first maximum light output.

9. The lighting system of claim 8, wherein:

the first light-emitting diode unit of the given one of the lighting fixtures includes a first quantity of light-emitting diodes;

the second light-emitting diode unit of the given one of the lighting fixtures includes a second quantity of light-emitting diodes; and the first and second quantities are the same.

10. The lighting system of claim 8, wherein:

the first light-emitting diode unit of the given one of the lighting fixtures includes a first quantity of light-emitting diodes;

the second light-emitting diode unit of the given one of the lighting fixtures includes a second quantity of light-emitting diodes; and the first and second quantities are different.

11. A system, comprising:

a plurality of fixtures individually including— a first unit having a plurality of electrically coupled solid-state devices, and a second unit having a plurality of electrically coupled solid-state devices;

a power source;

first wiring operably connecting the first units to the power source;

second wiring operably connecting the second units to the power source;

an automatic controller operably connected to the first wiring;

a battery; and a battery relay operably connected to the power source, the battery, and the second wiring, the battery relay having a first state in which the battery relay operably connects the second wiring and the power source and a second state in which the battery relay operably connects the second wiring and the battery, wherein— the first units operate independently of the battery, and the second units operate independently of the automatic controller such that the second unit of a given one of the lighting fixtures operates independently of the first unit of the same lighting fixture.

12. A lighting fixture, comprising;

a housing;

a first lighting circuit including a plurality of first light-emitting diodes;

a first lead operably connected to the first lighting circuit and accessible from an exterior of the housing;

a second lighting circuit including a plurality of second light-emitting diodes interspersed among the first light-emitting diodes;

a second lead operably connected to the second lighting circuit and accessible from the exterior of the housing; and an automatic controller including an occupancy sensor, wherein the second lighting circuit operates independently of the automatic controller.

13. A lighting fixture, comprising:

a housing;

a first lighting circuit including a plurality of first light-emitting diodes;

a first lead operably connected to the first lighting circuit and accessible from an exterior of the housing;

a second lighting circuit including a plurality of second light-emitting diodes interspersed among the first light-emitting diodes;

a second lead operably connected to the second lighting circuit and accessible from the exterior of the housing;

an on/off switch operably connected to the second lighting circuit, the on/off switch being configured for manual operation; and an automatic controller operably connected to the first lighting circuit, wherein the second lighting circuit operates independently of the automatic controller.

14. A method for operating a lighting system, the method comprising:

temporarily reducing power to a first lighting-emitting diode unit in a lighting fixture in response to an automatically generated occupancy signal from an occupancy sensor; and continuously powering a second light-emitting diode unit in the lighting fixture without reducing power to the second light-emitting diodes unit while temporarily reducing power to the first light-emitting diode unit, wherein the first and second light-emitting diode units individually include one or more light-emitting diodes.

15. A method for operating a lighting system, the method comprising;

temporarily reducing power to a first light-emitting diode unit in a lighting fixture in response to an automatically generated signal; and continuously powering a second light-emitting diode unit in the lighting fixture using a battery without reducing power to the second light-emitting diode unit while temporarily reducing power to the first light-emitting diode unit, wherein the first and second light-emitting diode units individually include one or more light-emitting diodes.

16. A method for operating a lighting system, the method comprising;

positioning a plurality of light fixtures proximate one or more areas to be illuminated, the lighting fixtures individually including— a first light-emitting diode unit, a first lead operably connected to the first light-emitting diode unit, a second light-emitting diode unit, and a second lead operably connected to the second light-emitting diode unit;

operably connecting first wiring to the first leads and a power source;

operably connecting second wiring to the second leads and the power source;

operably connecting a demand-response controller to the first wiring such that the second light-emitting diode units operate independently of the demand-response controller, the demand-response controller being a first automatic controller; and operably connecting a second automatic controller to the first wiring, the second automatic controller including an occupancy sensor.

17. The lighting fixture of claim 12, wherein a maximum light output of the second light-emitting diodes is less than about 25% of a maximum light output of the first light-emitting diodes.

18. The lighting fixture of claim 12, further comprising a junction switch operably connected to the first and second lighting circuits, the junction switch having a first state in which the junction switch operably connects the first and second lighting circuits and a second state in which the first and second lighting circuits are electrically isolated from one another.

19. The method of claim 15, wherein reducing power to the first light-emitting diode unit includes opening a normally closed relay.

20. The method of claim 15, wherein the automatically generated signal is a demand-response signal.

21. The method of claim 15, further comprising float charging the battery.

22. The method of claim 16, wherein the plurality of lighting fixtures is a first plurality of lighting fixtures, and the method further comprises:

positioning a second plurality of lighting fixtures proximate one or more of the same or different areas to be illuminated, the second plurality of lighting fixtures individually including— a first light-emitting diode unit, a first lead operably connected to the first light-emitting diode unit, a second light-emitting diode unit, and a second lead operably connected to the second light-emitting diode unit;

operably connecting the first and second light-emitting diode units of the individual lighting fixtures of the second plurality of lighting fixtures;

operably connecting the first wiring to one of the first and second leads of the individual lighting fixtures of the second plurality of lighting fixtures; and capping the other of the first and second leads of the individual lighting fixtures of the second plurality of lighting fixtures.

23. The method of claim 22, wherein:

positioning the first plurality of lighting fixtures includes positioning the first plurality of lighting fixtures proximate an egress area; and positioning the second plurality of lighting fixtures includes positioning the second plurality of lighting fixtures proximate a non-egress area.

24. The method of claim 22, wherein:

the first and second lighting fixtures are the same before operably connecting the first and second light-emitting diode units of the individual lighting fixtures of the second plurality of lighting fixtures;

positioning the first and second pluralities of lighting fixtures includes positioning the first and second pluralities of lighting fixtures proximate the same area to be illuminated; and changing a maximum light output of the second light emitting diode units by changing a quantity of the second plurality of lighting fixtures relative to a quantity of the first plurality of lighting fixtures.

25. The system of claim 11, wherein the automatic controller includes a normally closed relay.

26. The system of claim 11, further comprising a controlled-access switch operably connected to the second wiring.

27. The system of claim 11, wherein the power source includes:

a load center of a building; and shared wiring between the load center and the first and second wiring.

28. The system of claim 11, wherein the automatic controller includes a normally open relay.

29. The system of claim 11, wherein the automatic controller is a demand-response controller configured to receive a demand-response signal.

30. The system of claim 11, wherein the battery is a float-charged battery.

* * * * *

UNITED STATES PATENT AND TRADEMARK OFFICE

CERTIFICATE OF CORRECTION

PATENT NO. : 8,829,797 B2
APPLICATION NO. : 13/598374
DATED : September 9, 2014
INVENTOR(S) : McMahon It is certified that error appears in the above-identified patent and that said Letters Patent is hereby corrected as shown below:

In the Claims

Column 10, line 35, Claim 12, delete “comprising;” and insert -- comprising: --, therefor.

Column 11, line 14, Claim 15, delete “comprising;” and insert -- comprising: --, therefor.

Column 11, line 26, Claim 16, delete “comprising;” and insert -- comprising: --, therefor.

Signed and Sealed this
Eleventh Day of November, 2014

Michelle K. Lee

Michelle K. Lee
*Deputy Director of the United States Patent and Trademark Office*